US005643483A

United States Patent [19]

Kubota et al.

[11] Patent Number: 5,643,483

[45] Date of Patent: Jul. 1, 1997

[54] CERAMIC HEATER MADE OF FUSED SILICA GLASS HAVING ROUGHENED SURFACE

[75] Inventors: Yoshihiro Kubota; Hiroshi Mogi, both of Gunma-ken, Japan

[73] Assignee: Shin-Etsu Chemical Co., Ltd., Tokyo, Japan

[21] Appl. No.: 400,847

[22] Filed: Mar. 8, 1995

[30] Foreign Application Priority Data

Apr. 11, 1994 [JP] Japan ..... 6-071787

[51] Int. Cl.[6] ..... H05B 3/16; H01C 1/012

[52] U.S. Cl. ..... 219/543; 219/548; 338/308; 392/434; 392/438

[58] Field of Search ..... 219/543, 548, 219/203, 464; 338/307–308, 314, 309; 392/438–439, 434; 29/611, DIG. 1, DIG. 7, DIG. 23; 165/DIG. 517; 156/657.1, 659.11

[56] References Cited

U.S. PATENT DOCUMENTS

| | | | |
|---|---|---|---|
| 3,811,934 | 5/1974 | Glaser | 219/543 |
| 5,304,784 | 4/1994 | Tagashira et al. | 338/307 |
| 5,431,741 | 7/1995 | Sakaguchi et al. | 136/244 |

FOREIGN PATENT DOCUMENTS

| | | |
|---|---|---|
| 3-053055 | 3/1991 | Japan . |
| 32183 | 2/1992 | Japan . |
| 4-141947 | 5/1992 | Japan . |
| 4-202064 | 7/1992 | Japan . |
| 238853 | 9/1993 | Japan . |
| 5-338235 | 12/1993 | Japan . |
| 6-140133 | 5/1994 | Japan . |

*Primary Examiner*—Teresa J. Walberg
*Assistant Examiner*—Raphael Valencia
*Attorney, Agent, or Firm*—McAulay Fisher Nissen Goldberg & Kiel, LLP

[57] ABSTRACT

An improvement is proposed in a ceramic heater which is an integral body comprising a flat substrate plate made from an electrically insulating ceramic material, e.g., fused silica glass, and a layer of an electroconductive material formed on one surface of the substrate plate in a pattern of an electric heater element. One of the surfaces of the insulating substrate plate, on which the heater layer is formed, is subjected to a surface roughening treatment, e.g., by sand blasting, prior to the formation of the heater layer so as to be imparted with a specified surface roughness so that the heat generated in the heater layer and transmitted to the other surface as infrared rays is irregularly scattered .

7 Claims, 1 Drawing Sheet

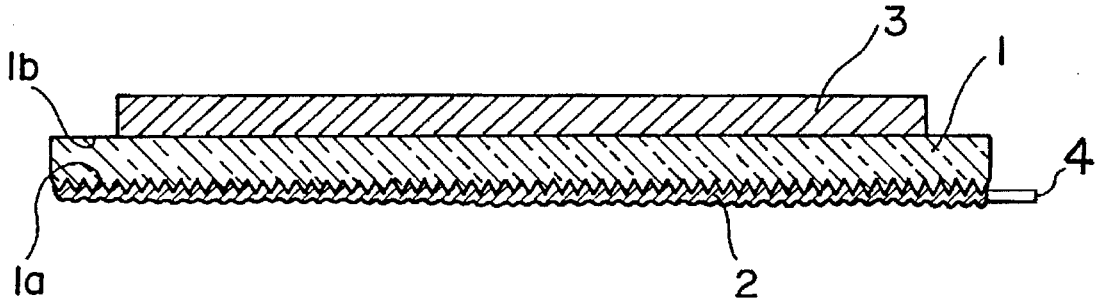
3
1
1b
4
1a
2

CERAMIC HEATER MADE OF FUSED SILICA GLASS HAVING ROUGHENED SURFACE

BACKGROUND OF THE INVENTION

The present invention relates to a novel ceramic heater for use in the manufacturing process of various kinds of electronic devices on which semiconductor silicon wafers as a substrate of semi-conductor devices, glass plates as a substrate of liquid crystal display panels and the like are mounted and heated in the course of the chemical vapor-phase deposition treatment, sputtering treatment and the like to form a thin film thereon or plasma etching treatment of the substrate surface. More particularly, the invention relates to a ceramic heater used in the above mentioned applications which is characterized by the greatly improved uniformity of the temperature distribution allover the surface thereof on which the workpiece such as semiconductor wafers and glass plates are mounted and heated. The invention also relates to a method for the preparation of such an improved ceramic heater.

Needless to say, the manufacturing process of various kinds of electronic devices almost always involves a step in which a semi-conductor silicon wafer as a substrate of semiconductor devices, glass plate as a substrate of liquid crystal display panels or the like is mounted on a heater and heated and kept at an elevated temperature suitable for processing of the substrate for film formation, etching and the like. A most conventional or traditional heater element used in such a heater is a high-resistivity metal wire wound in the form of a coil to serve as a resistance heater element. In view of the disadvantageous bulkiness of such a coiled heater element of a metal wire of high resistivity, proposals have been made, for example, in Japanese Patent Kokai No. 63-241921 and No. 4-124076 for a so-called ceramic heater which is an integral body comprising a substrate plate of an electrically insulating ceramic material and a layer of an electroconductive heat-resistant material formed on one surface of the substrate plate in the pattern of a heater element connected to an electric power source. The workpiece to be heated by the ceramic heater is mounted on the other surface of the substrate plate opposite to the surface on which the patterned heater layer is provided.

The ceramic heaters in the prior art mentioned above have several problems and disadvantages. When the ceramic heater is used by repeatedly heating up to a working temperature for the workpiece and cooling down to room temperature, for example, cracks are sometimes formed in the substrate plate and/or the patterned heater layer as a consequence of the thermal stress due to the repeated temperature elevation and lowering to cause circuit breaking or short circuiting. In some cases, separation or exfoliation may eventually take place between the substrate plate and the patterned layer of the electroconductive heat-resistant material as a consequence of the difference in the thermal expansion coefficients therebetween. A proposal has been made for the use of a fused silica glass plate as the substrate plate of a ceramic heater in view of the excellent resistance of fused silica glass plates against crack formation. A problem in such a ceramic heater by using a fused silica glass plate as the substrate is that, since fused silica glass is highly transparent to the light of visible to infrared region, the heat generated in the patterned heater layer is directly transmitted through the transparent substrate plate by thermal radiation so that the temperature of the surface of the substrate plate opposite to the patterned heater layer, on which a workpiece is mounted for heating, is more or less uneven or non-uniform following the temperature distribution in the patterned heater layer. This problem is more serious when the ceramic heater has large dimensions increased to comply with the requirement for processing of a workpiece of a larger and larger size because the unevenness in the temperature distribution on the surface of the ceramic heater directly influences the quality level of the products manufactured therewith and decreases the yield of acceptable products.

SUMMARY OF THE INVENTION

The present invention accordingly has an object to provide a novel and improved ceramic heater of which an outstandingly uniform temperature distribution can be ensured on the surface of the substrate plate opposite to the patterned heater layer, on which a workpiece is mounted and heated, even when the material forming the substrate plate is fused silica glass.

Thus, the present invention provides an improved ceramic heater which comprises, as an integral body:

(a) a substrate plate having two oppositely facing generally flat surfaces and made from an electrically insulating ceramic material or, preferably, from fused silica glass, one of the two oppositely facing flat surfaces having a surface roughness Rmax in the range from 2 μm to 200 μm; and (b) a layer made from an electroconductive heat-resistant material formed on and in direct contact with the surface of the substrate plate having a surface roughness Rmax in the range from 2 μm to 200 μm in a pattern of an electric heater element.

The invention also provides an improvement, in the method for the preparation of a ceramic heater comprising the step of forming a layer of an electroconductive heat-resistant material in a pattern of an electric heater element on one surface of a substrate plate made from an electrically insulating ceramic material, which comprises, prior to the formation of the electroconductive layer on one of two oppositely facing flat surfaces, subjecting one of the surfaces of the substrate plate, on which the electroconductive layer is formed, to a surface roughness adjustment treatment so that the surface is imparted with a surface roughness Rmax in the range from 2 μm to 200 μm.

BRIEF DESCRIPTION OF THE DRAWING

The figure schematically illustrates a vertical cross sectional view of an inventive ceramic heater with a workpiece mounted thereon.

DETAILED DESCRIPTION OF THE PREFERRED EMBODIMENTS

As is described above, the improvement obtained by the present invention is characterized by the unique roughness condition of the substrate surface on which the patterned heater layer of an electroconductive heat-resistant material is formed, the general structure of the ceramic heater being rather conventional in other respects. This unique invention has been completed as a result of the extensive investigations undertaken by the inventors on the base of an idea that, when the substrate surface, on which the patterned heater layer of an electroconductive heat-resistant material is to be formed, is imparted with an adequate roughness, the thermal radiation of the heat generated in the heater layer mainly in the form of infrared rays is transmitted not directly from one surface to the other surface of the substrate plate therethrough but after irregular scattering at the microscopic protrusions and recesses on the roughened surface so that a great improvement could be obtained in the uniformity of the temperature distribution over the substrate surface on which a workpiece is mounted and heated even when the material of the substrate plate is fused silica glass having high transparency to infrared rays.

The substrate plate as an element of the ceramic heater according to the invention, on one surface of which a patterned heater layer is formed from an electroconductive heat-resistant material, is made from an electrically insulating ceramic material including fused silica glass, sapphire, alumina, aluminum nitride, silicon nitride, pyrolytic boron nitride and the like without particular limitations while fused silica glass, which is less preferable in the prior art ceramic heaters for the reasons mentioned above, is particularly preferred because this material is highly resistant against crack formation by the thermal stress and free from the problem of contamination of silicon semiconductor wafers. Synthetic fused silica glass is preferred to natural fused silica glass in respects of the higher purity, higher heat resistance, higher uniformity and higher mechanical and thermal properties including higher hardness, smaller thermal expansion coefficient and higher impact strength.

Although the dimensions of the substrate plate are not particularly limitative in order to comply with the particular requirements for the use of the ceramic heater, the thickness of the substrate plate is usually in the range from 0.1 mm to 100 mm or, preferably, from 1 mm to 10 mm. When the thickness of the substrate plate is too small, the ceramic heater would be mechanically fragile to cause an inconvenience in handling while, when the thickness is too large, a decrease is caused in the efficiency of thermal energy utilization if not to mention the disadvantage due to the unduly large weight also to cause inconvenience in handling. The planar dimensions of the substrate plate should be large enough so that a workpiece of any largest dimensions can be mounted on the ceramic heater. For example, the planar dimensions of the substrate plate sometimes must be large enough to mount a large-size glass plate for a liquid crystal display panel, which is required in recent years to be as large as 400 mm by 500 mm or even larger.

While fused silica glass plates conventionally available on the market and to be used as the electrically insulating substrate of the ceramic heater according to the invention usually have a surface roughness Rmax not exceeding 0.1 μm, it is essential according to the invention that the surface of the substrate plate, on which the electric heater layer is formed from an electroconductive heat-resistant material, is imparted with a surface roughness Rmax in the range from 2 μm to 200 μm or, preferably, from 50 μm to 170 μm or, more preferably, from 100 μm to 150 μm by undertaking a suitable surface roughness adjustment treatment or surface roughening treatment. When the surface roughness of the substrate plate is too small or, i.e. the surface is too smooth, the desired improvement to be obtained by the irregular scattering of the infrared rays would be insufficient while, when the surface roughness is too large or, i.e. the surface is too coarse, a problem is caused in respect of the compatibility of the substrate surface with the patterned electric heater layer formed thereon and decrease in the uniformity of heat generation in the heater layer.

The method for the surface roughening treatment of the substrate surface is not particularly limitative depending on the particular materials of the substrate plate and the desired surface roughness. For example, applicable surface roughening methods include the method of sand blasting, chemical etching, plasma etching and the like. The roughness of the substrate surface thus roughened can be determined by using a contact probe-type surface roughness tester.

The surface roughness of the other surface, which is opposite to the surface in contact with the patterned heater layer, is not particularly limitative but, since the surface is for mounting of a workpiece thereon, the surface should preferably be as smooth as possible because a smooth surface is advantageous in respect of the better heat transfer from the ceramic heater to the workpiece thereon and less contamination by the deposition of foreign materials than otherwise. The surface of a conventional fused silica glass plate has a satisfactorily small surface roughness Rmax of, for example, in the range from 0.01 μm to 0.1 μm without a surface polishing treatment.

After the above mentioned surface roughening treatment of one of the substrate surfaces, a patterned electric heater layer is formed from a heat-resistant electroconductive material on the thus roughened surface of the substrate plate. The electroconductive material is not particularly limitative including, for example, pyrolytic graphite and the like. Pasty dispersion of particles of a metallic material such as tungsten, platinum-silver alloy and the like can be used for the formation of the patterned heater layer. The method for the formation of the patterned heater layer is not limitative depending on the electroconductive heat-resistant material from which the layer is to be formed. For example, a layer of pyrolytic graphite can be formed by the chemical vapor-phase deposition method and a patterned layer of a metal paste can be formed by the method of screen printing followed by baking. The methods of sputtering, electron-beam vapor-deposition, spray coating and the like are also applicable depending on the material of the heater layer. Thickness of the patterned heater layer is also not particularly limitative depending on the electroconductive material thereof as well as the desired temperature for heating of workpieces.

While the ceramic heater of the invention essentially comprises the substrate plate made from an electrically insulating ceramic material and a patterned layer of a heat-resistant electroconductive material formed on the roughened surface of the substrate plate to serve as the heater element, it is of course optional that an electrically insulating or protective layer is formed on the patterned heater layer so that the ceramic heater has a three-layered structure.

In the following, Examples and Comparative Examples are given to illustrate the invention in more detail.

EXAMPLE 1

As is illustrated in the figure of the accompanying drawing by a vertical cross sectional view, a 200 mm by 200 mm wide square plate 1 of synthetic fused silica glass having a thickness of 5 mm, of which the surface had a roughness Rmax of 0.01 μm, was subjected to a sand blasting treatment on one of the flat surfaces so that the surface was imparted with a surface roughness Rmax of 150 μm by the determination with a contact probe-type surface roughness tester as is shown by the wavy line 1*a* in the figure.

In the next place, screen printing was performed on the thus roughened surface 1*a* of the fused silica glass plate as the substrate with a platinum-silver paste to form a coating layer 2 of the paste having a thickness of 5 μm as dried in a double-spiral pattern having a line width of 10 mm and a space width of 2 mm followed by baking of the same in air at 900° C. for 3 hours to form a patterned electroconductive layer which served as a heater element after being provided with terminals 4 to be connected with a power source to complete a ceramic heater.

A semiconductor silicon wafer 3 having a diameter of 180 mm and thickness of 0.5 mm was mounted on the smooth surface 1*b* of the substrate plate opposite to the roughened surface 1*a* and heated up to about 750° C. with the center of the wafer just on the center of the ceramic heater. After about 5 minutes when a stationary heating condition had been established, distribution of temperature on the wafer surface was examined by measuring the temperature at each of the crossing points of down and across parallel lines drawn in advance in a checkerboard-like fashion with a distance of 20 mm between two adjacent lines. The result was that the lowest and highest temperatures determined were 750° C. and 755° C., respectively, with a difference of only 5° C.

Separately, a durability test was undertaken for the ceramic heater by repeatedly heating and cooling the same between room temperature and 800° C. as measured at the center position to find that the working condition of the ceramic heater was stable and complete after 500 times or more of the repeated cycles of temperature elevation and lowering.

Comparative Example 1

The procedures for the preparation and testing of a second ceramic heater were substantially the same as in Example 1 described above except that the sand blasting treatment of one of the surfaces of the fused silica glass plate was omitted. The result of the temperature distribution test was that the lowest and highest temperatures determined were 715° C. and 763° C., respectively, with a difference of 48° C. The result of the durability test was that exfoliation of the patterned heater layer off the substrate surface took place after 85 times of the repeated cycles of temperature elevation and lowering.

Comparative Example 2

The procedures for the preparation and testing of a third ceramic heater were substantially the same as in Example 1 except that the sand blasting treatment of one of the surfaces of the fused silica glass plate 1 was performed to such an extent that the surface 1*a* was imparted with a surface roughness Rmax of 1 μm. The result of the temperature distribution test was that the lowest and highest temperatures determined were 730° C. and 780° C., respectively, with a difference of 50° C.

Comparative Example 3

The procedures for the preparation and testing of a fourth ceramic heater were substantially the same as in Example 1 except that the sand blasting treatment of one of the surfaces of the fused silica glass plate 1 was performed to such an extent that the surface 1*a* was imparted with a surface roughness Rmax of 250 μm. The result of the temperature distribution test was that the lowest and highest temperatures determined were 747° C. and 789° C., respectively, with a difference of 42° C. The result of the durability test was that exfoliation of the patterned heater layer off the substrate surface 1*a* took place after 250 times of the repeated cycles of temperature elevation and lowering.

EXAMPLE 2

The procedures for the preparation and testing of a fifth ceramic heater were substantially the same as in Example 1 except that the sand blasting treatment of one of the surfaces of the fused silica glass plate 1 was performed to such an extent that the surface 1*a* was imparted with a surface roughness Rmax of 10 μm. The result of the temperature distribution test was that the difference between the lowest and highest temperatures determined was 6° C. The result of the durability test was that exfoliation of the patterned heater layer off the substrate surface 1*a* did not take place up to 500 times of the repeated cycles of temperature elevation and lowering.

EXAMPLE 3

The procedures for the preparation and testing of a sixth ceramic heater were substantially the same as in Example 1 except that the sand blasting treatment of one of the surfaces of the fused silica glass plate 1 was performed to such an extent that the surface 1*a* was imparted with a surface roughness Rmax of 80 μm. The result of the temperature distribution test was that the difference between the lowest and highest temperatures determined was 5° C. The result of the durability test was that exfoliation of the patterned heater layer off the substrate surface 1*a* did not take place up to 500 times of the repeated cycles of temperature elevation and lowering.

What is claimed is:

1. A ceramic heater which comprises, as an integral body:

(a) a substrate plate having two oppositely facing flat surfaces and made from an electrically insulating synthetic fused silica glass, one of the two oppositely facing flat surfaces having a surface roughness Rmax in the range from 2 μm to 200 μm; and (b) an electric heater element comprising a layer made from an electroconductive heat-resistant material formed on an in direct contact with the surface of the substrate plate having a surface roughness Rmax in the range from 2 μm to 200 μm.

2. The ceramic heater as claimed in claim 1 in which one of the two oppositely facing flat surfaces of the substrate plate has a surface roughness Rmax in the range from 50 μm to 170 μm.

3. The ceramic heater as claimed in claim 3 in which one of the two oppositely facing flat surfaces of the substrate plate has a surface roughness Rmax in the range from 100 μm to 150 μm.

4. In a method for the preparation of a ceramic heater comprising a step of forming an electric heater element on a layer of an electroconductive heat-resistant material on one surface of a substrate plate made from an electrically insulating synthetic fused silica glass and having two oppositely facing flat surfaces, the improvement which comprises, prior to the formation of the electroconductive layer on one of the two oppositely facing flat surfaces, subjecting said surface of the substrate plate, on which the electroconductive layer is formed, to a surface roughness adjustment treatment so that the surface is imparted with a surface roughness Rmax in the range from 2 μm to 200 μm.

5. The improvement as claimed in claim 4 in which the surface roughness adjustment treatment is performed by the method of sand blasting.

6. The improvement as claimed in claim 4 in which the surface after the surface roughness adjustment treatment has a surface roughness Rmax in the range from 50 μm to 170 μm.

7. The improvement as claimed in claim 6 in which the surface after the surface roughness adjustment treatment has a surface roughness Rmax in the range from 100 μm to 150 μm.

* * * * *